United States Patent [19]

Mitchell et al.

[11] 4,183,800

[45] * Jan. 15, 1980

[54] INDIRECT HEAT RETORTING PROCESS WITH COCURRENT AND COUNTERCURRENT FLOW OF HYDROCARBON-CONTAINING SOLIDS

[75] Inventors: David S. Mitchell; David R. Sageman, both of San Rafael, Calif.

[73] Assignee: Chevron Research Company, San Francisco, Calif.

[ * ] Notice: The portion of the term of this patent subsequent to Jan. 9, 1996, has been disclaimed.

[21] Appl. No.: 891,084

[22] Filed: Mar. 28, 1978

[51] Int. Cl.[2] ..... C10G 1/00

[52] U.S. Cl. ..... 208/8 R; 208/11 R

[58] Field of Search ..... 208/11 R, 8

[56] References Cited

U.S. PATENT DOCUMENTS

| | | | |
|---|---|---|---|
| 2,557,680 | 6/1951 | Odell | 208/11 R |
| 2,723,951 | 11/1955 | Minet | 208/8 X |
| 2,984,602 | 5/1961 | Nevens et al. | 208/11 R X |
| 3,483,116 | 12/1969 | Hoffert | 208/11 R |
| 3,484,364 | 12/1969 | Hemminger | 208/11 R |
| 3,501,394 | 3/1970 | Lyons | 208/11 R |
| 4,064,018 | 12/1977 | Choi | 208/8 X |
| 4,087,347 | 5/1978 | Langlois et al. | 208/11 R |
| 4,092,237 | 5/1978 | Reed | 208/11 R |

FOREIGN PATENT DOCUMENTS

| | | | |
|---|---|---|---|
| 236769 | 6/1959 | Australia | 208/11 |
| 658163 | 2/1963 | Canada . | |

*Primary Examiner*—Delbert E. Gantz
*Assistant Examiner*—William G. Wright
*Attorney, Agent, or Firm*—D. A. Newell; R. H. Davies; R. H. Evans

[57] ABSTRACT

A continuous process is disclosed for the retorting of oil shale or other similar hydrocarbon containing solids. Heat carrier particles at an elevated temperature are introduced into an upper portion of a retort and pass downwardly therethrough, fluidized by an upwardly flowing non-oxidizing gas introduced in a lower portion of the retort. The hydrocarbon-containing solids are introduced into an intermediate portion of the retort; a first portion thereof being entrained by the gas and flowing upwardly through the retort and a second portion thereof being fluidized by the gas and flowing downwardly through said retort. Retorted fluidized solids and heat carrier particles are removed from a lower portion of the retort and a product stream of hydrocarbon vapors mixed with the entrained retorted solids and fluidizing gas is recovered overhead.

7 Claims, 2 Drawing Figures

INDIRECT HEAT RETORTING PROCESS WITH COCURRENT AND COUNTERCURRENT FLOW OF HYDROCARBON-CONTAINING SOLIDS

BACKGROUND OF THE INVENTION

1. Field of the Invention

The present invention relates to a process for retorting hydrocarbon-containing solids, such as oil shale, in a combined fluidized-entrained bed.

2. Description of the Prior Art

Vast natural deposits of shale in Colorado, Utah and Wyoming contain appreciable quantities of organic matter which decomposes upon pyrolysis to yield oil, hydrocarbon gases and residual carbon. The organic matter or kerogen content of said deposits has been estimated to be equivalent to approximately 4 trillion barrels of oil. As a result of the dwindling supplies of petroleum and natural gas, extensive research efforts have been directed to develop retorting processes which will economically produce shale oil on a commercial basis from these vast resources.

In principle, the retorting of shale and other similar hydrocarbon-containing solids simply comprises heating the solids to an elevated temperature and recovering the vapors evolved. However, as medium-grade oil shale yields approximately 25 gallons of oil per ton of shale, the expense of materials handling is critical to the economic feasibility of a commercial operation. The choice of a particular retorting method must therefore take into consideration the raw and spent materials handling expense, as well as product yield and process requirements.

Process heat requirements may be supplied either directly or indirectly. Directly heated retorting processes rely upon the combustion of fuel in the present of the oil shale to provide sufficient heat for retorting. Such processes result in lower product yields due to unavoidable combustion of some of the product and dilution of the product stream with the products of combustion. Indirectly heated retorting processes, however, generally use a separate furnace or equivalent vessel in which a solid or gaseous heat carrier medium is heated. The hot heat carrier is subsequently mixed with the hydrocarbon-containing solids to provide process heat, thus resulting in higher yields while avoiding dilution of the retort product with combustion products, but at the expense of additional materials handling. The indirectly heated retort systems which process large shale or which use a gaseous heat transfer medium generally have lower throughputs per retort volume than the systems wherein smaller shale is processes or solid heat carriers are used.

In essentially all above-ground processes for the retorting of shale, the shale is first crushed to reduce the size of the shale to aid in materials handling and to reduce the time required for retorting. Many of the prior art processes, typically those processes which use moving beds, cannot tolerate excessive amounts of shale fines whereas other processes, such as the entrained bed retorts, require that all of the shale processed be of relatively small particle size, and still other processes, such as those using fluidized beds, require the shale to be of uniform size as well as being relatively small. Unfortunately, crushing operations have little or no control over the breadth of the resultant particle size distribution, as this is primarily a function of the rock properties. Thus, classification of the crushed shale to obtain the proper size distribution is normally required prior to retorting in most of the existing prior art processes and, in the absence of multiple processing schemes, a portion of the shale must be discarded.

In certain indirectly heated prior art retorts the hot heat carrier and shale are mechanically mixed in a horizontally inclined vessel. This mechanical mixing often results in high-temperature zones conducive to undesirable thermal cracking and/or low-temperature zones which result in incomplete retorting. Furthermore, as solids gravitate to the lower portion of the vessel, stripping the retorted shale with gas is inefficient and results in lower product yields due to readsorption of a portion of the evolved hydrocarbons by the retorted solids.

Prior art fluidized bed retorts have the advantages of uniform mixing and excellent solids-to-solids contacting over the mechanically mixed retorts; however, there is little control over the individual particle residence time. Thus, in such processes partially retorted material is necessarily removed with the retorted solids, leading to either costly separation and recycle of partially retorted materials, lowered product yields, or use of larger retort volumes. Furthermore, the gross mixing attained in such retorts results in poor stripping and readsorption of the product by the retorted solids. It must also be noted that it is very difficult to maintain a conventional stable fluidized bed of shale without extensive classification efforts to obtain relatively uniform particle sizes.

SUMMARY OF THE INVENTION

In accordance with the present invention there is provided, in a process wherein raw hydrocarbon-containing particles are retorted in a vertically elongated retort by heating said hydrocarbon-containing particles to retorting temperatures by heat transfer from solid heat carrier particles passed through said retort from an upper portion thereof, the improvement which comprises:

(a) passing a non-oxidizing gas upwardly through said retort from a lower portion thereof at a rate sufficient to maintain said heat carrier particles in a fluidized state;

(b) introducing said raw hydrocarbon-containing particles into an intermediate portion of said retort;

(c) maintaining the size of said raw hydrocarbon-containing particles such that a first portion of said raw hydrocarbon-containing particles is entrained by said gas and passes upwardly through the retort countercurrently to the downwardly moving heat carrier particles, whereby said first portion of hydrocarbon-containing particles is heated to form a first portion of retorted solids and hydrocarbonaceous materials driven from said retorted solids, and such that a second portion of said raw hydrocarbon-containing particles is fluidized by said gas and passes downwardly through the retort cocurrently with the downwardly moving heat carrier particles, whereby said second portion of hydrocarbon-containing particles is heated to form a second portion of retorted solids and hydrocarbonaceous materials driven from said retorted solids;

(d) maintaining substantially plug flow of the solids and gases through the retort by limiting gross vertical backmixing of said solids and gases;

(e) withdrawing effluent solids from a lower portion of the retort, which effluent solids include the heat carrier particles and the second portion of retorted solids; and (f) withdrawing the first portion of the retorted solids, the non-oxidizing gas, and the hydrocarbonaceous materials driven from said first and second portions of the retorted solids from an upper portion of the retort.

Although the process is not limited thereto, the hydrocarbon-containing particles may comprise coal, tar sands, oil shale and gilsonite, and the solid heat carrier particles may comprise previously retorted solids, sand, refractory type solids or mixtures thereof. The non-oxidizing gas is preferably steam, hydrogen, or gas withdrawn from said retort and recycled thereto.

The invention may further comprise:

passing a portion of said retorted solids and heat carrier particles, withdrawn from the retort, including solids having residual carbonaceous material, into a combustor separate from said retort;

contacting said retorted solids with an oxygen-containing gas under conditions which result in burning at least a portion of said carbonaceous material, thereby heating said retorted solids and heat carrier particles;

withdrawing said heated retorted solids and heat carrier particles from the combustor;

recycling at least a portion of said heated retorted solids and heat carrier particles to the retort as said heat carrier particles.

Further in accordance with the invention, said limiting of the gross vertical backmixing of the solids and gases is preferably attained by passing said solids and gases through barriers disposed in said retort, such as packing or other suitable fixed internals.

DETAILED DESCRIPTION OF THE INVENTION AND PREFERRED EMBODIMENTS

While the process of the present invention is described hereinafter with particular reference to the processing of oil shale, it will be apparent that the process can also be used to retort other hydrocarbon-containing solids such as gilsonite, peat, coal, mixtures of two or more of these materials, or any other hydrocarbon-containing solids with inert materials.

As used herein, the term "oil shale" refers to fine-grained sedimentary inorganic material which is predominantly clay, carbonates and silicates in conjunction with organic matter composed of carbon, hydrogen, sulfur and nitrogen, called "kerogen".

The terms "retorted hydrocarbon-containing particles" and "retorted solids" as used herein refer to hydrocarbon-containing solids from which essentially all of the volatizable hydrocarbons have been removed, but which may still contain residual carbon.

The term "spent shale" as used herein refers to retorted shale from which a substantial portion of the residual carbon has been removed, for example, by combustion in a combustion zone.

The terms "condensed", "noncondensable", "normally gaseous", or "normally liquid" are relative to the condition of the subject material at a temperature of 77° F. (25° C.) and a pressure of one atmosphere.

Particle size, unless otherwise indicated, is measured with respect to Tyler Standard Sieve sizes.

Figure 1:
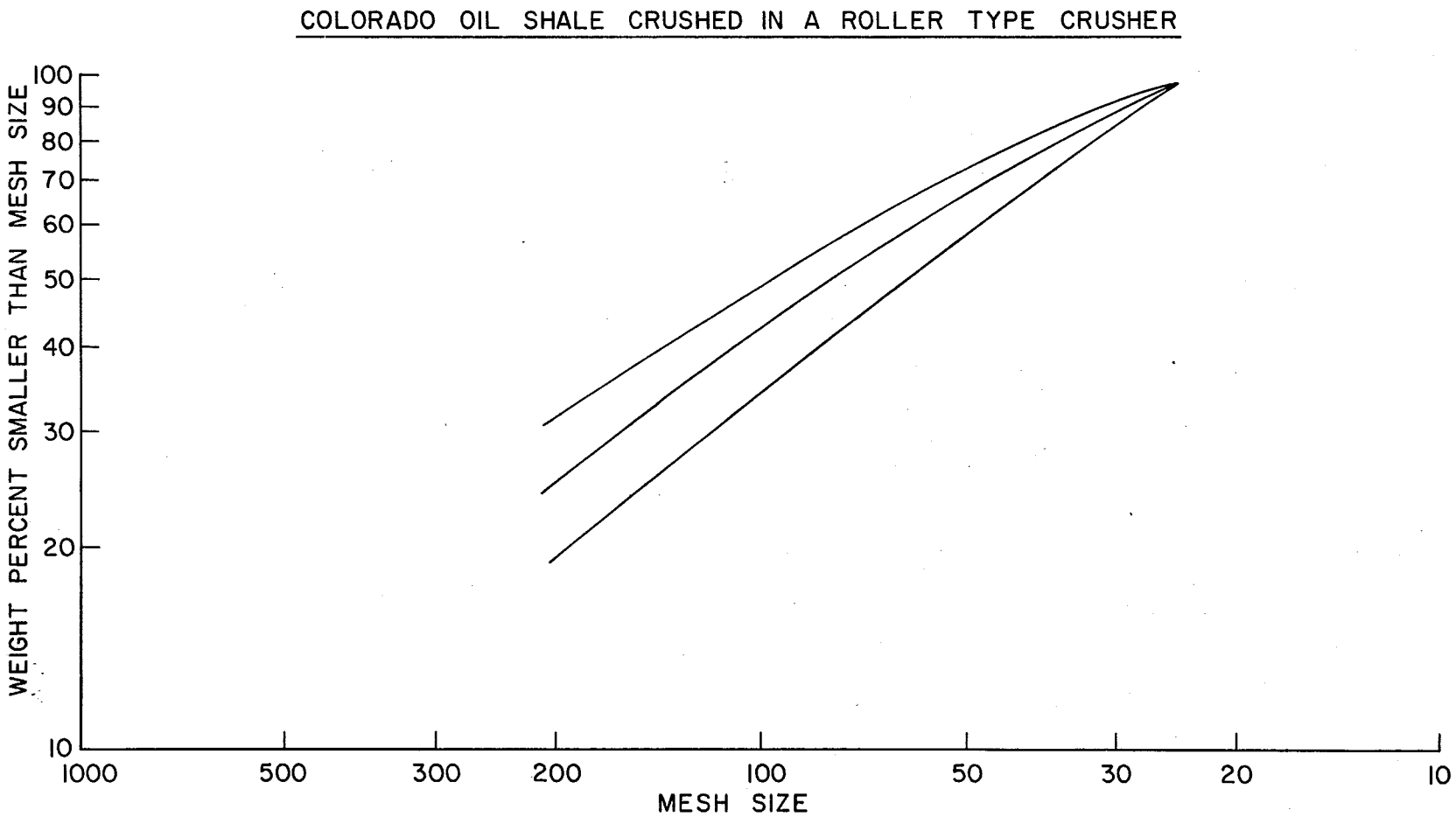
FIG. 1 graphically illustrates typical size distributions for crushed oil shale suitable for use in the present process.

Referring to the drawings and in particular to FIG. 1 thereof, examples of particle size and weight distributions are shown for various grades of Colorado oil shale processed by a roller crusher, such that 100% of the shale will pass through a 25 mesh screen. Particle sizes in this range are easily produced by conventional means. The crushing operations may be conducted to produce a maximum particle size, but little or no control is effected over the smaller particles produced. This is particularly true is regard to shale which tends to cleave into slab or wedge-shaped fragments. As shown in FIG. 1, the maximum particle size is 25 mesh but substantial quantities of smaller shale particles, typically ranging down to 200 mesh and below, are also produced. Shale particles having such a relatively broad size distribution are generally unsuitable for moving bed retorts since the smaller shale particles fill the interstices between the larger shale particles, thereby resulting in bridging of the bed and interrupted operations. Therefore, it is normally required to separate most of the fines from crushed shale prior to processing in a moving bed retort. This procedure naturally results in additional classification expenses as well as diminished resource utilization.

Such particle sizes are also unsuitable for use in conventional fluidized beds since, for a given gas velocity, only a portion of the particles will fluidize and higher gas velocities sufficient to fluidize the larger shale particles will cause entrainment of the smaller particles. Furthermore, the partial fluidization attained is highly unstable, tending to channel or slug.

Figure 2:
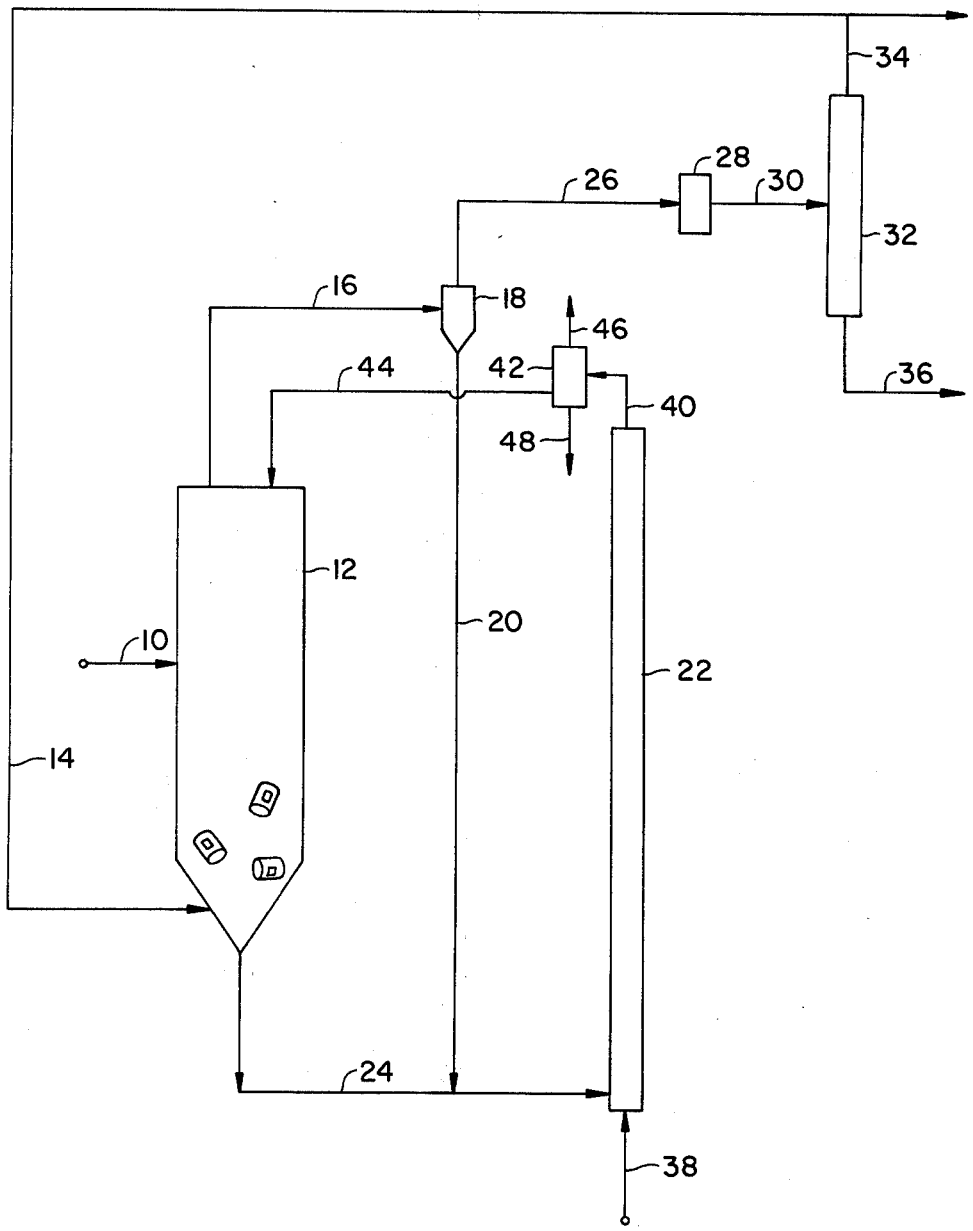
FIG. 2 is a schematic flow diagram of one embodiment of apparatus and flow paths suitable for carrying out the process of the present invention in the retorting of shale.

Referring now to FIG. 2 of the drawings, raw shale particles are introduced through line 10 into an intermediate portion of a vertically elongated retort 12. Hot heat carrier particles, such as previously retorted shale, are introduced to an upper portion of said retort via line 44. A stripping gas, substantially free of molecular oxygen, is introduced through line 14 to a lower portion of retort 12 and passes upwardly therethrough, fluidizing the heat carrier. A first portion of the raw shale particles is entrained by the stripping gas and passes upwardly through the retort from the point of entry, countercurrent to the downwardly moving heat carrier. A second portion of the raw shale is fluidized by the stripping gas and passes downwardly through the retort, cocurrently with the heat carrier particles. Product vapors stripped from the retorted solids, stripping gas and the entrained retorted solids pass overhead from the retort through line 16 to a separation zone 18. Product vapors and stripping gas, separated in zone 18 from the entrained solids, and passing therefrom via line 26, are cooled in zone 28 and introduced as feed to distillation column 32. In column 32 the fuel is separated into a gaseous product and a liquid product which exit the column through lines 34 and 36, respectively. A portion of the gaseous product is recycled via line 14 to the retort to serve as stripping gas.

The entrained retorted solids separated from the product vapors and stripping gas pass from zone 18 through line 20 to line 24. Effluent retorted solids and heat carrier particles are removed from a lower portion of the retort 12 and passed through line 24 to a lower portion of combustor 22.

Air is introduced to combustor 22 via line 38 and provides oxygen to burn residual carbon on the retorted solids. The carbon combustion heats the retorted solids and heat carrier particles which are removed with the flue gas from an upper portion of the combustor through line 40 and pass to a separation zone 42. A portion of the hot previously retorted shale, preferably above 50 mesh, is recycled from zone 42 through line 44 to the retort to provide process heat. Hot flue gas and the remaining solid particles pass from separation zone 42 through lines 46 and 48, respectively.

The temperature of the spent shale or heat carrier introduced to the retort via line 44 will normally be in the range of 1100° F.–1500° F., depending upon the selected operating ratio of heat carrier to shale. The raw shale may be introduced to the retort through line 10 at ambient temperature or preheated if desired to reduce the heat transfer required between fresh shale and heat carrier. The temperature at the top of the retort should be maintained within the broad range, 850° F. to 1000° F., and is preferably maintained in the range of 900° F. to 950° F.

The weight ratio of spent shale heat carrier to fresh shale may be varied from approximately 1.5:1 to 8:1 with a preferred weight ratio in the range of 2.0:1 to 3:1. It has been observed that some loss in product yield occurs at the higher weight ratios of spent shale to fresh shale and it is believed that the cause for such loss is due to increased adsorption of the retorted hydrocarbonaceous vapor by the larger quantities of spent shale. Furthermore, attrition of the spent shale, which is a natural consequence of retorting and combustion of the shale, occurs to such an extent that high recycle ratios cannot be achieved with spent shale alone. If it is desired to operate at the higher recycle ratios of heat carrier to fresh shale, sand may be substituted as part or all of the heat carrier.

A stripping gas is introduced, via line 14, into a lower portion of the retort and passes upwardly through the vessel fluidizing the downwardly moving spent shale. The flow rate of the stripping gas should be maintained to produce a superficial gas velocity at the bottom of the vessel in the range of approximately 1 foot per second to 20 feet per second, with a preferred superficial velocity in the range of 3 feet per second to 7 feet per second. The stripping gas may be comprised of steam, recycle product gas, hydrogen or any inert gas. It is particularly important, however, that the stripping gas selected be essentially free of molecular oxygen to prevent product combustion within the retort.

The raw crushed shale, typically having a size distribution as shown in FIG. 1, is introduced by conventional means through line 10 to an intermediate portion of the retort. For the purposes of describing the process, it is assumed that the shale has a particle size distribution similar to the distribution shown in FIG. 1 of the drawings; however, the invention should not be construed as being limited to said particle sizes.

A portion of said fresh shale feed, for example, those particles smaller than 50 mesh, will be entrained by the fluidization gas and passed upwardly through the retort countercurrently to the downwardly moving hot spent shale. As the raw shale progresses upwardly through the retort it is heated by contact with the spent shale and the fluidization gas to retorting temperatures. The evolved hydrocarbonaceous materials from the retorted solids are swept from the column and passed overhead through line 16 with the entrained retorted solids and the fluidization gas.

The remaining portion of the raw oil shale, i.e., those particles larger than 50 mesh, is fluidized by the upwardly moving gas and flows downwardly through the retort cocurrently with the spent shale, and is thereby heated to retorting temperature. The evolved hydrocarbon vapor from said larger shale particles is stripped by the gas and carried upwardly through the retort. The retorted shale and spent shale are removed from the lower portion of said retort through line 24.

The mass flow rate of fresh shale through the retort should be maintained between 1000 lb/hr-ft$^2$ and 6000 lb/hr-ft$^2$, and preferably between 2000 lb/hr-ft$^2$ and 4000 lb/hr-ft$^2$. Thus, in accordance with the broader recycle heat carrier weight ratios stated above, the total solids mass rate will range from approximately 2,500 lb/hr-ft$^2$ to 54,000 lb/hr-ft$^2$.

An essential feature of the present invention lies in limiting the gross vertical backmixing of the moving shale and heat carrier to produce stable, substantially plug flow conditions throughout the retort volume. True plug flow, wherein there is little or no vertical backmixing of solids, allows much higher conversion levels of kerogen to vaporized hydrocarbonaceous material than can be obtained, for example, in a fluidized bed retort with gross top-to-bottom mixing. In conventional fluidized beds or in stirred tank-type reactors, the product stream removed approximates the average conditions in the reactor zone. Thus, in such processes partially retorted material is necessarily removed with the product stream, resulting in either costly separation and recycle of unreacted materials, reduced product yield, or a larger reactor volume. Maintaining substantially plug flow conditions by substantially limiting top-to-bottom mixing of solids, however, allows one to operate the process of the present invention on a continuous basis with a much greater control of the residence time of individual particles. The use of means for limiting substantial vertical backmixing of solids also permits a substantial reduction in size of the retort zone required for a given mass throughput, since the chances for removing partially retorted solids with the retorted solids are reduced. The means for limiting backmixing and limiting the maximum bubble size may be generally described as barriers, dispersers or flow redistributors, and may, for example, include spaced horizontal perforated plates, bars, screens, packing, or other suitable internals. A particularly preferred packing is pall rings.

Bubbles of fluidized solids tend to coalesce in conventional fluidized beds much as they do in a boiling liquid. However, when too many bubbles coalesce, surging or pounding in the bed results, leading to a significant loss of efficiency in contacting and an upward spouting of large amounts of material at the top of the bed. The means provided herein for limiting backmixing also limits the coalescence of large bubbles, thereby allowing the size of the disengaging zones to be somewhat reduced.

All gross backmixing should be avoided, but highly localized mixing is desirable in that it increases the degree of contacting between the solids and the solids and gases. The degree of backmixing is, of course, dependent on many factors, but is primarily dependent upon the particular internals or packing disposed within the retort.

Solids plug flow and countercurrent gas contacting also permits maintenance of a temperature gradient through the vessel. This feature is one which cannot be achieved with a conventional fluidized bed due to the gross uniform top-to-bottom mixing.

In the process of the present invention, upward flow of entrained solid material is substantially impeded by the means employed for limiting gross vertical backmixing. In most cases, depending upon the choice of particular means for impeding gross mixing throughout the reaction zone and other factors, the solids hold-up time of entrained solids is at least several times and often orders of magnitude greater than the prior art processes. This aspect of the process is particularly important, because in many retorting processes the retorting vessels frequently represent 10% to 50% of the capital cost of the process. By doubling the entrained solids hold-up time, capital costs can be substantially reduced.

The overhead product effluent stream from the retort, comprised of hydrocarbonaceous material admixed with retorted solids and stripping gas, passes through line 16 to separation zone 18 wherein the retorted solids are removed from the balance of the stream. This operation may be effected by any suitable or conventional means such as hot cyclones, pebble beds and/or electrostatic precipitators. Preferably the retorted solids which are separated from the product effluent stream pass via lines 20 and 24 to a combustor, generally characterized by reference numeral 22. Product effluent, free of retorted solids, passes from the separation zone via line 26. At this juncture, conventional and well-known processing methods may be used to separate the normaly liquid oil product from the product effluent stream. For example, the stream could be cooled by heat exchange in cooling zone 28 to produce steam and then separated into its normally gaseous and liquid components in distillation column 32. A portion of the gaseous product leaving the distillation column, via line 34, may be conveniently recycled to retort 12, via line 14, for use as stripping gas. If preferred, the gas may be preheated prior to return to the retort or introduced at the exit temperature from the distillation column. The remainder of the product gas passes to storage or additional processing and the normally liquid product is withdrawn from column 32 via line 36.

The retorted shale solids along with spent shale serving as heat carrier is removed from the lower portion of the retort via line 24 by conventional means at the retort temperature. The retorted shale will have a residual carbon content of approximately 3 to 4 weight percent and represents a valuable source of energy which may be used to advantage in the process. From line 24 the retorted shale and spent shale are fed to a lower portion of combustor 24. While combustor 24 may be of conventional design, it is preferred that same be a dilute phase lift combustor. Air is injected into the lower portion of the combustor via line 38 and the residual carbon on the shale is partially burned. The carbon combustion heats the retorted shale to a temperature in the range of 1100° F. to 1500° F. and the hot shale and flue gas are removed from the upper portion of the combustor via line 40 and passed to separation zone 42. A portion of said hot shale is recycled via line 44 to provide heat for the retort. Preferably said recycled shale is classified to remove substantially all of the minus 50 mesh shale prior to introduction to the retort to minimize entrained fines carryover in the effluent product vapor. Hot flue gases are removed from the separation zone via line 46 and waste spent solids are passed from the zone via line 48. The clean flue gas and/or spent solids passing from zone 42 via lines 46 and 48 may be used to provide heat for stream generation or for heating process streams.

What is claimed is:

1. In a process wherein raw hydrocarbon-containing particles are retorted in a vertically elongated retort by heating said hydrocarbon-containing particles to retorting temperatures by heat transfer from solid heat carrier particles passed through said retort from an upper portion thereof, the improvement which comprises:

(a) passing a non-oxidizing gas upwardly through said retort from a lower portion thereof at a rate sufficient to maintain said heat carrier particles in a fluidized state;

(b) introducing said raw hydrocarbon-containing particles into an intermediate portion of said retort;

(c) maintaining the size of said raw hydrocarbon-containing particles such that a first portion of said raw hydrocarbon-containing particles is entrained by said gas and passes upwardly through the retort countercurrently to the downwardly moving heat carrier particles, whereby said first portion of hydrocarbon-containing particles is heated to form a first portion of retorted solids and hydrocarbonaceous materials driven from said retorted solids, and such that a second portion of said raw hydrocarbon-containing particles is fludized by said gas and passes downwardly through the retort cocurrently with the downwardly moving heat carrier particles, whereby said second portion of hydrocarbon-containing particles is heated to form a second portion of retorted solids and hydrocarbonaceous materials driven from said retorted solids;

(d) maintaining substantially plug flow of the solids and gases through the retort by limiting gross vertical backmixing of said solids and gases;

(e) withdrawing effluent solids from a lower portion of the retort, which effluent solids include the heat carrier particles and the second portion of retorted solids; and (f) withdrawing the first portion of retorted solids, the non-oxidizing gas, and the hydrocarbonaceous materials driven from said first and second portions of the retorted solids from an upper portion of the retort.

2. A process as recited in claim 1, wherein said hydrocarbon-containing particles are selected from the group consisting of coal, tar sands, oil shale and gilsonite.

3. A process as recited in claim 1, wherein said solid heat carrier particles are selected from the group consisting of previously retorted solids, sand, refractory-type solids, and mixtures thereof.

4. A process as recited in claim 1, wherein said non-oxidizing gas is selected from the group consisting of steam, hydrogen and gas withdrawn from said retort and recycled thereto.

5. A process as recited in claim 1, further comprising:

passing a portion of said retorted solids and heat carrier particles, withdrawn from the retort, including solids having residual carbonaceous material, into a combustor separate from said retort;

contacting said retorted solids with an oxygen-containing gas under conditions which result in burning at least a portion of said carbonaceous material, thereby heating said retorted solids and heat carrier particles;

withdrawing said heated retorted solids and heat carrier particles from the combustor; and recycling at least a portion of said heated retorted solids and heat carrier particles to the retort as said heat carrier particles.

6. A process as recited in claim 1, wherein said limiting of the gross vertical backmixing of the solids and gases is attained by passing said solids and gases through barriers disposed in said retort.

7. A process as recited in claim 6, wherein said barriers are selected from the group consisting of packing and fixed internals.

* * * * *